US006820455B1

(12) United States Patent
Bainter

(10) Patent No.: US 6,820,455 B1
(45) Date of Patent: Nov. 23, 2004

(54) METAL WORKING MACHINE

(76) Inventor: Wesley Allen Bainter, P.O. Box 705, Hoxie, KS (US) 67740

( * ) Notice: Subject to any disclaimer, the term of this patent is extended or adjusted under 35 U.S.C. 154(b) by 230 days.

(21) Appl. No.: 10/039,801

(22) Filed: Jan. 4, 2002

Related U.S. Application Data

(60) Provisional application No. 60/322,829, filed on Sep. 17, 2001.

(51) Int. Cl.[7] ..... B21D 9/05; B21J 13/02

(52) U.S. Cl. ..... 72/455; 72/441; 72/389.3; 72/389.6; 72/47; 100/214; 100/257

(58) Field of Search ..... 72/389.1, 389.3, 72/389.6, 389.8, 441, 455, 472; 100/214, 257

(56) References Cited

U.S. PATENT DOCUMENTS

| | | | | | |
|---|---|---|---|---|---|
| 447,849 | A | | 3/1891 | Todd | |
| 3,142,174 | A | | 7/1964 | Baker | |
| 3,701,276 | A | | 10/1972 | Malmgren | |
| 4,030,335 | A | | 6/1977 | Allenspach | |
| 4,112,731 | A | | 9/1978 | Anderson et al. | |
| 4,242,903 | A | * | 1/1981 | Ledford et al. | 72/455 |
| 4,250,784 | A | | 2/1981 | Bredow | |
| 4,283,825 | A | * | 8/1981 | McKay et al. | 72/429 |
| 4,457,197 | A | * | 7/1984 | Wepner et al. | 83/197 |
| 4,506,433 | A | | 3/1985 | Gingras | |
| 4,561,284 | A | | 12/1985 | Kisslig | |
| 4,574,611 | A | * | 3/1986 | Hegemann | 72/389.3 |
| 4,615,208 | A | * | 10/1986 | Hailey | 72/455 |
| 4,662,207 | A | * | 5/1987 | McDonald | 72/453.07 |
| 4,696,180 | A | * | 9/1987 | Zandel | 72/455 |
| 4,730,825 | A | | 3/1988 | Mikusch et al. | |
| 4,738,018 | A | | 4/1988 | Ebrahimian | |
| 4,920,779 | A | | 5/1990 | Post | |
| 5,001,921 | A | | 3/1991 | Schneider et al. | |
| 5,483,814 | A | | 1/1996 | Liet | |
| 5,834,082 | A | | 11/1998 | Day | |
| 5,836,196 | A | * | 11/1998 | Smith | 72/455 |
| 5,875,673 | A | | 3/1999 | Brzezniak et al. | |
| 5,996,392 | A | | 12/1999 | Garth | |
| 6,053,027 | A | | 4/2000 | Yoshizawa | |
| 6,085,570 | A | | 7/2000 | Preaus | |
| 6,109,090 | A | | 8/2000 | Perazzolo | |
| 6,122,952 | A | | 9/2000 | Ashwill et al. | |
| 6,185,974 | B1 | | 2/2001 | Venturini | |
| 6,196,041 | B1 | | 3/2001 | Codatto | |

* cited by examiner

*Primary Examiner*—David B Jones

(57) ABSTRACT

The invention metal working machine includes a stationary frame and a moving frame. Both the stationary frame and the moving frame carry opposite corresponding tool dies that perform metal working operations when the moving frame translates relative to the stationary frame. The moving frame is arranged so that one end can move while the other end remains stationary. Hydraulic cylinders on each end of the metal working machine are connected by pivot joints between the stationary frame and moving frame. When both of the hydraulic cylinders are activated in the same direction, the entire moving frame moves up or down relative to the stationary frame. If only one of the hydraulic cylinders is activated, only one side of the moving frame translates while the other side of the moving frame moves only slightly.

13 Claims, 4 Drawing Sheets

METAL WORKING MACHINE

CROSS REFERENCES TO RELATED APPLICATIONS

This application claims the benefit of U.S. Provisional Patent Application No. 60/322,829 filed Sep. 17, 2001.

FIELD OF THE INVENTION

This invention pertains to metal working machines and more particularly to an improved metal working machine which is able to shear sheet metal, bend sheet metal, punch sheet metal and metal plate as well as shear angle extrusions.

BACKGROUND OF THE INVENTION

An operator of a metal fabrication shop must procure a number of machines to perform various metal fabrication operations. Such operations include break forming, shearing and punching. In a break forming operation, a sheet metal workpiece is positioned between two corresponding male and female dies that are brought together to form a bend in the workpiece. In a shearing operation, a sheet metal workpiece is placed between blades that are brought together to shear the workpiece. Preferably, in a shearing operation, the blades meet at a slight angle so that only a portion of the workpiece is sheared at any given time. Extruded angles may be cut using an angle shear which generally includes an cutter portion and an anvil portion. A punch press having a punch tool and an anvil can be used to punch holes in sheet or plate workpeices.

Conventional multiple operation metal working machines are known as "iron workers". Iron workers typically can perform several operations in one machine. Malmgren, in U.S. Pat. No. 3,701,276 teaches an iron and metal working machine having a main beam that pivots to operate a punch press at one end and a sheet metal sheer and other selected metal working accessories at the opposite end. However, Malgren's machine, like many metal working machines of its type, has a configuration that prevents an operator from processing relatively large workpieces. Moreover, because of the configuration of prior art metal working machines such as the machine taught by Malgren, it is not possible to independently execute operations at opposite ends of the main beam. With prior art metal working machines, only one operation may be performed by one operator at any given type.

Thus, there has been a need in the metal working industry for a metal working machine that has a greater degree of versatility in performing operations on a larger range of workpieces and which can also be operated simultaneously by more than one operator to perform separate metal working tasks.

SUMMARY OF THE INVENTION

Accordingly, the principle object of the present invention is to provide a machine that includes a moving frame that moves in relation to a stationary frame so that metal working dies attached to the moving frame can be translated at both ends of the moving frame either simultaneously or independently. Another object of the present invention is to provide a machine that has opposite dies of a break form tool fixed to corresponding portions of the moving frame and the stationary frame so that as one end of the moving frame is translated by a greater distance than the other end of the moving frame, a contoured bend having a gradually increasing angle of bend along the length of the bend can be formed into a sheet metal workpiece. Yet another object of the present invention is to provide a machine that has opposing sheet metal shearing blades fixed to corresponding portions of the moving frame and the stationary frame so that both ends of the moving frame are translated together, a relatively large sheet metal workpiece may be cut across a distance that is a large portion of the width of the moving frame. Still yet another object of the present invention is to provide a machine having opposing sheet metal shearing blades fixed to the moving frame and the stationary frame so that as only one end of the moving frame is translated, a relatively small sheet metal workpiece may be cut at a location adjacent to the portion of the moving frame that is moving. Finally, it is an object of the present invention to provide metal working tools each having a moving die and a stationary die such as a punch press for punching holes in plate or a shear for cutting metallic extrusions where the moving die of a particular tool is fixed to the moving frame at one end of the moving frame and the stationary die is fixed to the stationary frame at the same end so that as the same end of the moving frame is translated, the moving die attached to that end of the moving frame moves in relation to its corresponding stationary die to perform an operation only at the moving end of the moving frame.

These and other objects of the invention are attained in an improved metal working machine that performs multiple operations. The invention metal working machine includes a stationary frame and a moving frame. Both the stationary frame and the moving frame carry opposite corresponding tool dies that perform metal working operations when the moving frame translates relative to the stationary frame. The stationary frame is a rigid, rectangular structure having two spaced columns and at least two horizontal beams connecting the spaced columns. The moving frame is a non-rigid pinned rectangular structure having two vertical members that are connected together at pinned joints by two horizontal beams. The moving frame is arranged so that one end can move while the other end remains stationary. When only one end of the moving frame is translated, the moving frame transforms from a rectangle to a parallelogram. The horizontal beams of the moving frame engage the columns of the stationary frame so that they can slide up and down relative to the columns of the stationary frame. The vertical members of the horizontal frame are positioned next to the columns of the stationary frame and slide along paths that are parallel to the columns of the stationary frame. Hydraulic cylinders on each end of the metal working machine are connected by pivot joints between the stationary frame and moving frame. When both of the hydraulic cylinders are activated in the same direction, the entire moving frame moves up or down relative to the stationary frame. If only one of the hydraulic cylinders is activated, only one side of the moving frame translates while the other side of the moving frame moves only slightly as it pivots about the pivot joint connecting it to the hydraulic cylinder which is not activated.

The horizontal members of the moving frame and the horizontal members of the stationary frame carry corresponding tool dies. Corresponding sheet metal cutting blades are attached to horizontal beams of the stationary frame and the moving frame so that when the moving frame translates the cutting blades pass each other to cut a workpiece. In the same way, a male break forming die is mounted to a horizontal member of the moving frame and a corresponding female break forming die is mounted to a horizontal beam of the stationary frame. When the moving frame translates, a sheet metal workpiece may be formed between the break forming dies.

Other metal working tools such as a shear for cutting extruded angles or a punch for punching holes In sheet or plate material can be mounted to adjacent portions of the left or right side of the stationary frame and the moving frame. Because these other metal working tools are mounted on the left or right side of the machine, a tool or set of tools on one side may be operated independently as only that side is translated.

BRIEF DESCRIPTION OF THE DRAWINGS

The invention may be best understood by those having ordinary skill in the art by reference to the following detailed description when considered in conjunction with the accompanying drawing in which.

DETAILED DESCRIPTION OF THE INVENTION

Figure 1:
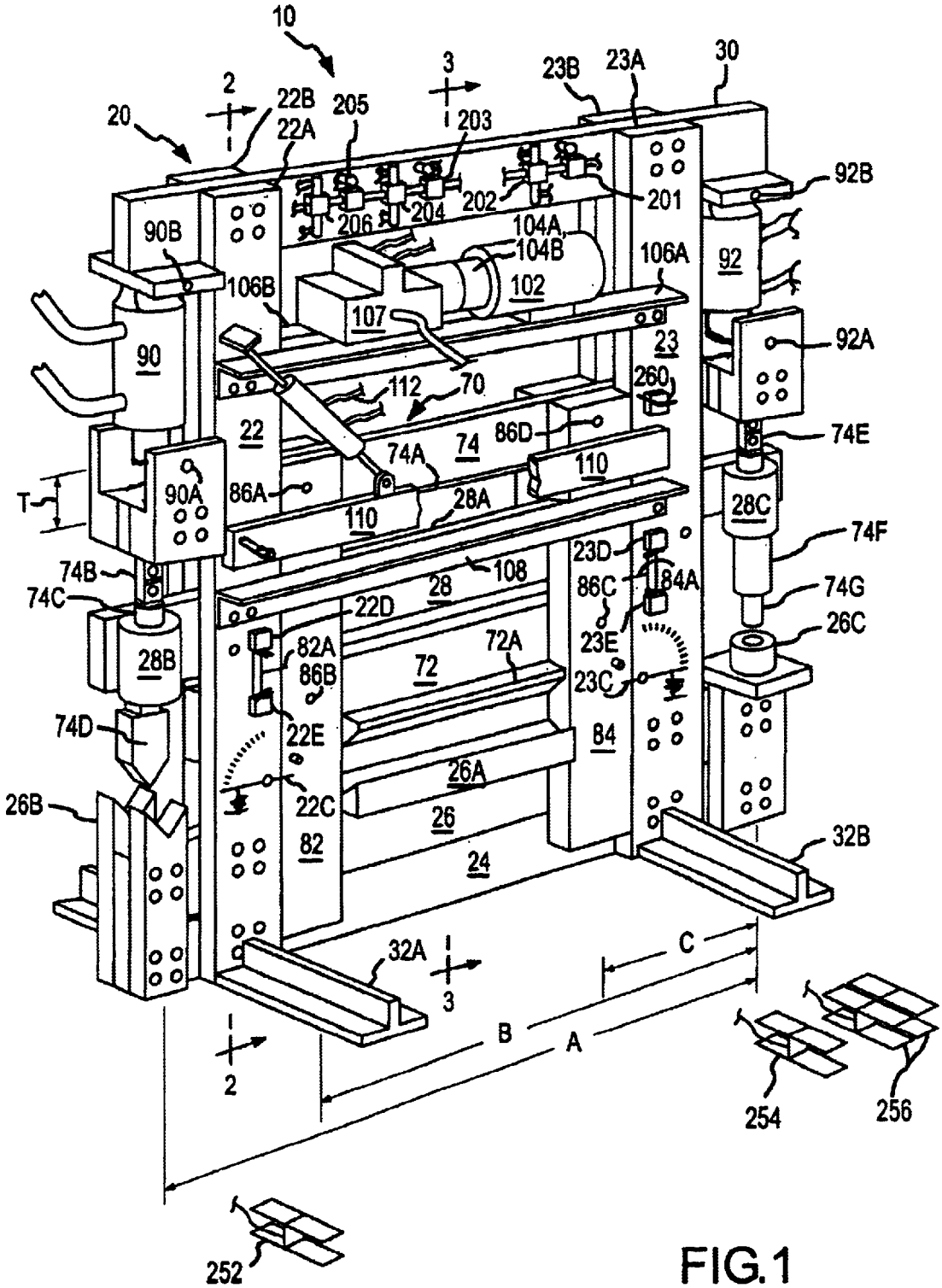
FIG. 1 is a perspective view of the metal working machine of the present invention.
Figure 2:
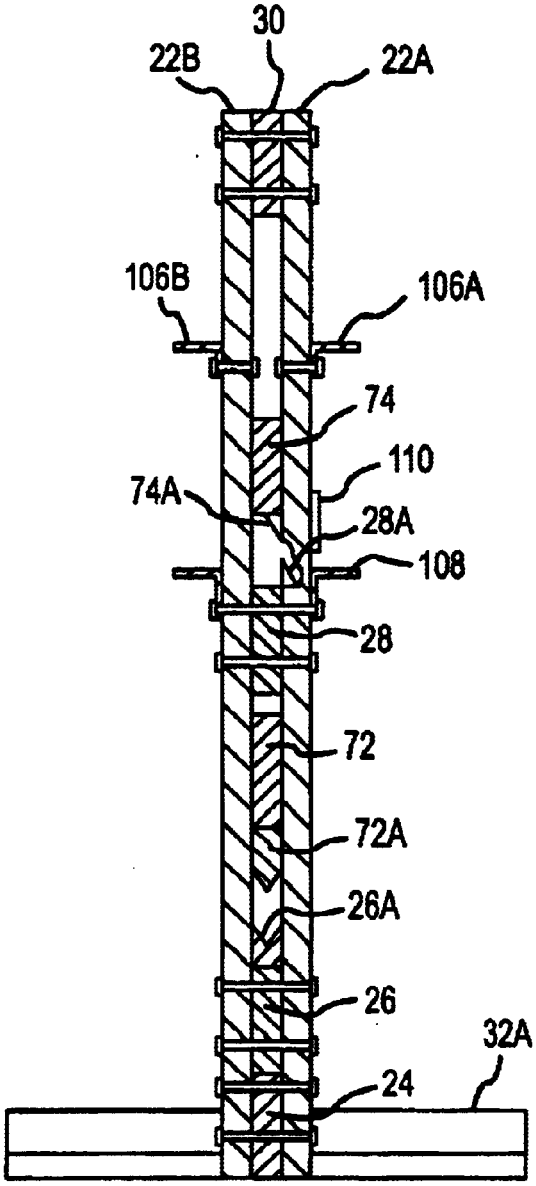
FIG. 2 is a sectional view of the metal working machine taken from plane 2—2 of FIG. 1.
Figure 3:
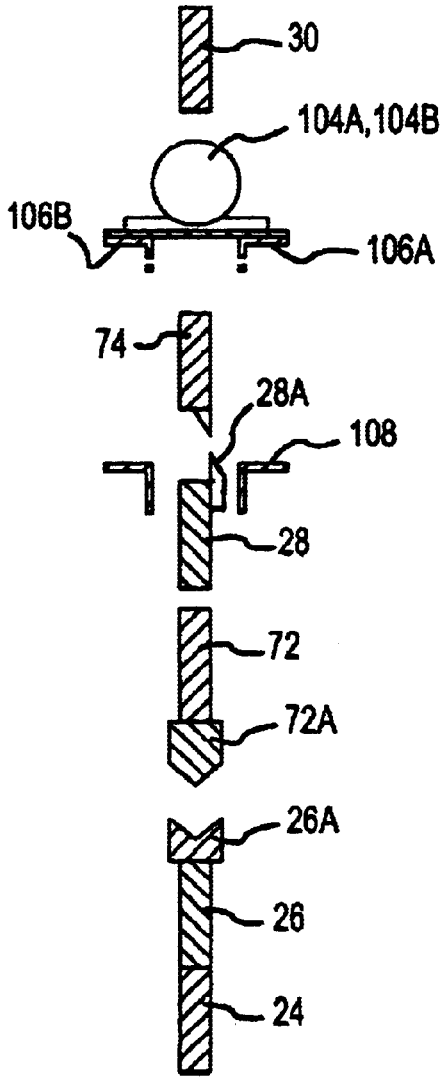
FIG. 3 is a sectional view of the metal working machine taken from plane 3—3 of FIG. 1.

Turning now to the drawings, wherein like reference numerals identify identical or corresponding elements, and more particularly to FIG. 1 thereof, a metal working machine 10 is shown having a stationary frame 20 and a moving frame 70. Stationary frame 20 and moving frame 70 are illustrated in FIG. 1, FIG. 2 and FIG. 3. FIG. 1 is a perspective view of machine 10 while FIG. 2 and FIG. 3 are sectional views taken from planes 2—2 and 3—3 of FIG. 1 respectively. FIG. 2 and FIG. 3 are intended to show the relative placement of the structural members of stationary frame 20 and moving frame 70.

Stationary frame 20 includes two vertical columns 22 and 23 each of which is built up from spaced vertical members 22A, 22B, 23A and 23B respectively. Stationary frame 20 is completed by a series of horizontal beams including a base beam 24, a first tool support beam 26, a second tool support beam 28 and a top beam 30. The horizontal beams of stationary frame 20 are rigidly fastened between the spaced vertical members of vertical columns 22 and 23 to form a rigid frame. Support legs 32A and 32B support stationary frame 20. A female break form die 26A is mounted to the top edge of first tool support beam 26. An angle iron cutting die 26B is mounted to the left outside end of first tool support beam 26 while a female hole punch die 26C is mounted to the right outside end. A cutting blade 28A is mounted to the top edge of second tool support beam 28. Tool guides 28B and 28C are mounted to the right and left ends of second tool support beam 28.

Moving frame 70 is generally mounted inside stationary frame 20. It includes two horizontal members 72 and 74 and two vertical members 82 and 84. Horizontal members 72 and 74 and vertical members 82 and 84 are pinned to each other at pivoting joints 86A, 86B, 86C and 86D to form a flexible parallelogram. Horizontal member 72 extends into the space between vertical members 22A and 22B of column 22 and vertical members 23A and 23B of column 23. Horizontal member 72 is sized to slide between the vertical members of columns 22 and 23. Horizontal member 74 extends out through the spaced vertical members of columns 22 and 23 and, like horizontal member 72, is sized to slide between the vertical members of columns 22 and 23 of stationary frame 20.

The central portions of moving frame 70 carry portions of two metal working tools: a slanted cutting blade 74A and a male break form die 72A. Slanted cutting blade 74A is fixed to the lower edge of horizontal member 74 and is positioned to cooperate with cutting blade 28A which is mounted to the top edge of second tool support beam 28 of stationary frame 20. In a similar fashion, male break form die 72A is mounted to the lower edge of horizontal member 72 and is positioned to cooperate with female break form die 26A which is mounted to the top edge of first tool support beam 26 of stationary frame 20. As is well known in the art, break form dies 72A and 26A could be designed to be removable and replaceable so that different forming operations can be selected for machine 10. It should be noted by the skilled reader that horizontal members 72, 74 as well as first and second tool support beams 26 and 28 can be designed to have a significantly greater length than that shown in FIG. 1 in order to accommodate wider workpieces. Still further, although the tools supported by these members as shown in FIG. 1 include a sheet metal shear and a break form tool, the reader should bear in mind that different types of tooling could be adapted for mounting to horizontal members 72 and 74 and corresponding tool support beams 26 and 28 so that other metal working operations may be performed by machine 10. The scope of the invention is by no means limited to the type or apparent size of tools illustrated in FIG. 1.

The outside portions of moving frame 70 are connected to tooling that cooperate with fixed elements that are mounted to stationary frame 20. A pivot link 74B, a shaft 74C and an angle iron cutting tool 74D are connected to the left end of horizontal member 74. Shaft 74C slides within tool guide 28B and can only move vertically. Pivot link 74B allows the left end of horizontal member 74 to pivot slightly while only hydraulic cylinder 92 at the opposite end of moving frame 70 is activated. When hydraulic cylinder 90 is activated, shaft 74C moves down to cause cutting tool 74D to pass against the stationary angle iron cutting die 26B. In a similar fashion, a pivot link 74E, a shaft 74F and a hole punch tool 74G are connected to the right end of horizontal member 74. Shaft 74F slides within tool guide 28C so that it can only move vertically. Pivot link 74E allows the right end of horizontal member 74 to pivot slightly while only hydraulic cylinder 90 at the opposite end of frame 70 is activated. When hydraulic cylinder 92 is activated, shaft 74F moves down to cause hole punch tool 74G to pass through stationary hole punch die 26C. Although FIG. 1 illustrates the placement of a hole punch dies on one end of machine 10 and angle cutting dies on the other end of machine 10, the skilled reader should bear in mind that interchangeable, or removable units could be devised so that any one of a number of selected tools could be placed at either end of machine 10 so that the scope of the invention should not be understood to be limited to the placement of the tools shown in FIG. 1.

Moving frame 70 is connected to stationary frame 20 by a right hydraulic cylinder 90 and a left hydraulic cylinder 92. The outside ends of horizontal member 74 are connected by lower pivot joints 90A and 92A to hydraulic cylinders 90 and 92. The outside ends of the stationary top horizontal beam 30 are also connected by upper pivot joints 90B and 92B to hydraulic cylinders 90 and 92. As hydraulic cylinders 90 and 92 are activated, moving frame 70 translates relative to stationary frame 20 as each end of horizontal member 74 moves relative to the corresponding ends of beam 30. It is also possible to translate only one side of moving frame 70. For example, if only hydraulic cylinder 90 is activated, horizontal member 74 pivots about pivot joint 92A while vertical member 82 moves by a significant distance. The distance by which vertical member 82 moves when only hydraulic cylinder 90 is activated can be determined by comparing the distances between the various pivot points. For example, distance A shown in FIG. 1 is the horizontal distance between hydraulic cylinder pivot joints 92A and 90A. Distance B is the horizontal distance between hydraulic cylinder pivot joint 92A and moving frame joint 86A. Distance C is the horizontal distance between hydraulic cylinder pivot joint 92A and moving frame joint 86D. When only hydraulic cylinder 90 is activated, pivot joint 90A will move down by a vertical distance T. When this movement of pivot joint 90A occurs, the movement of pivot joint 86A will be T×(B/A) and the significantly smaller movement of pivot joint 86D will be T×(C/A). Symmetrical and opposite translations will occur when only hydraulic cylinder 92 is activated. When moving frame 70 is translated in such a one sided manner, it changes from a rectangular shape to a parallelogram shape. When this happens, the horizontal distance between vertical members 82 and 84 decreases slightly. Although vertical members 82 and 84 move closer to each other, they maintain their vertical orientation while they slide relative to columns 22 and 23 of stationary frame 20.

A one sided translation of moving frame 70 on the right side can be employed to execute a cut in a relatively narrow sheet metal workpiece that is positioned toward the right end of cutting blade 28A. By activating only cylinder 92, only the right end of slanted cutting blade 74A passes against the stationary cutting blade 28A to accomplish a sheet metal cutting operation on the right side of metal working machine 10.

By translating each end of moving frame 70 by different amounts it is also possible to form a tapered or contoured bend in a sheet metal work piece placed between female break form die 26A and male break form die 72A. When either hydraulic cylinder 90 or 92 is activated, the corresponding end of male break form die 72A closest to the activated cylinder translates by a greater distance than the other end. Accordingly, by translating each end of moving fame 70 by different amounts, it is possible to form a contoured bend into a workpiece. Gauges such as gauges 22C and 23C can be used to measure the relative displacement of each end of moving frame 70 so that the degree of bend as well as the contour of a bend may be carefully controlled. Optical or digital displacement measuring devices may also be used in combination with electronic or digital control systems so that the relative movement of vertical members 82 and 84 relative to stationary frame 20 might be measured and controlled. As will be described in greater detail below, a pair of adjustable limit switches 22D and 22E on the left side of machine 10 as well as a pair of adjustable limit switches 23D and 23 E on the right side of machine 10 can be employed to select the relative movement of vertical members 82 and 84 relative to stationary frame 20. Although machine 10 as described and shown in FIG. 1 shows the use of preferred hydraulic cylinders 90 and 92, any form of suitable actuator may be selected to translate moving frame 70 in relation to stationary frame 20.

The tool and die arrangements on the left and right sides of metal working machine 10 can be operated independently because they are aligned with the pivot joints of each of the hydraulic cylinders. When only hydraulic cylinder 90 is activated, shaft 74C moves down to cause cutting tool 74D to pass against angle iron cutting die 26B. However, pivot joint 92A does not move when only hydraulic W cylinder 90 is activated. When hydraulic cylinder 90 is activated and hydraulic cylinder 92 is not activated, horizontal member 74 of moving frame 70 pivots about joint 92A. This pivoting does cause a slight movement at pivot link 74E but no significant movement of shaft 74F and punch tool 74G. Because of this ability to operate these tools one at a time, cutting tool 74D and punch tool 74G can both be operated independently by activating hydraulic cylinders 90 and 92 independently. This makes it possible for two operators to perform independent operations with machine 10 at the same time.

As can be seen in FIG. 1, a workpiece support member 108 is mounted to stationary frame 20 for supporting sheet material when it is positioned between the cutting blades of the sheering tool. A camping member 110 is mounted to stationary frame 20 so that It can slide up and down relative to stationary frame 20. A hydraulic cylinder 112 communicates between stationary frame 20 and clamping member 110. When hydraulic cylinder 112 extends, it forces clamping member 110 down on to workpiece support member 108 to clamp any sheet material workpiece that might have been placed between the blades of the cutting tool.

As is also shown in FIG. 1, other components are mounted to stationary frame 20 that support the operation of the various tools of metal working machine 10. An electric motor 102 and a hydraulic pumps 104A and 104B are mounted to stationary frame 20 by support angles 106A and 106B. Electric motor 102 provides power to hydraulic pumps 104A and 104B which supply pressurized hydraulic fluid to the various hydraulic cylinders of the machine. A set of solenoid controlled valves 202, 204 and 206 have neutral as well as up and down flow positions. These valves control the flow of hydraulic fluid between pumps 104A and 104B and hydraulic cylinders 90,92 and 112. The valves are arranged so that both hydraulic cylinder 90 and hydraulic 92 may be extended or retracted in unison to cause moving frame 70 to move up or down in a level fashion. The valves that control the flow of hydraulic fluid between pumps 104A and 104B and hydraulic cylinders 90 and 92 are also configured so that, from either end of the machine, only one of the pair of hydraulic cylinders 90 and 92 might be extended or retracted to perform an operation at one end of the machine as only one side of moving frame 70 is moved as described above. A separate valve is provided to control the flow of hydraulic fluid between pump 104 and hydraulic cylinder 112 to control the extension of hydraulic cylinder 112 to urge clamping member 110 into clamping contact with a workpiece placed on workpiece support member 108. The arrangement of the hydraulic system and control of valves 202, 204 and 206 is described in greater detail below.

Figure 4:
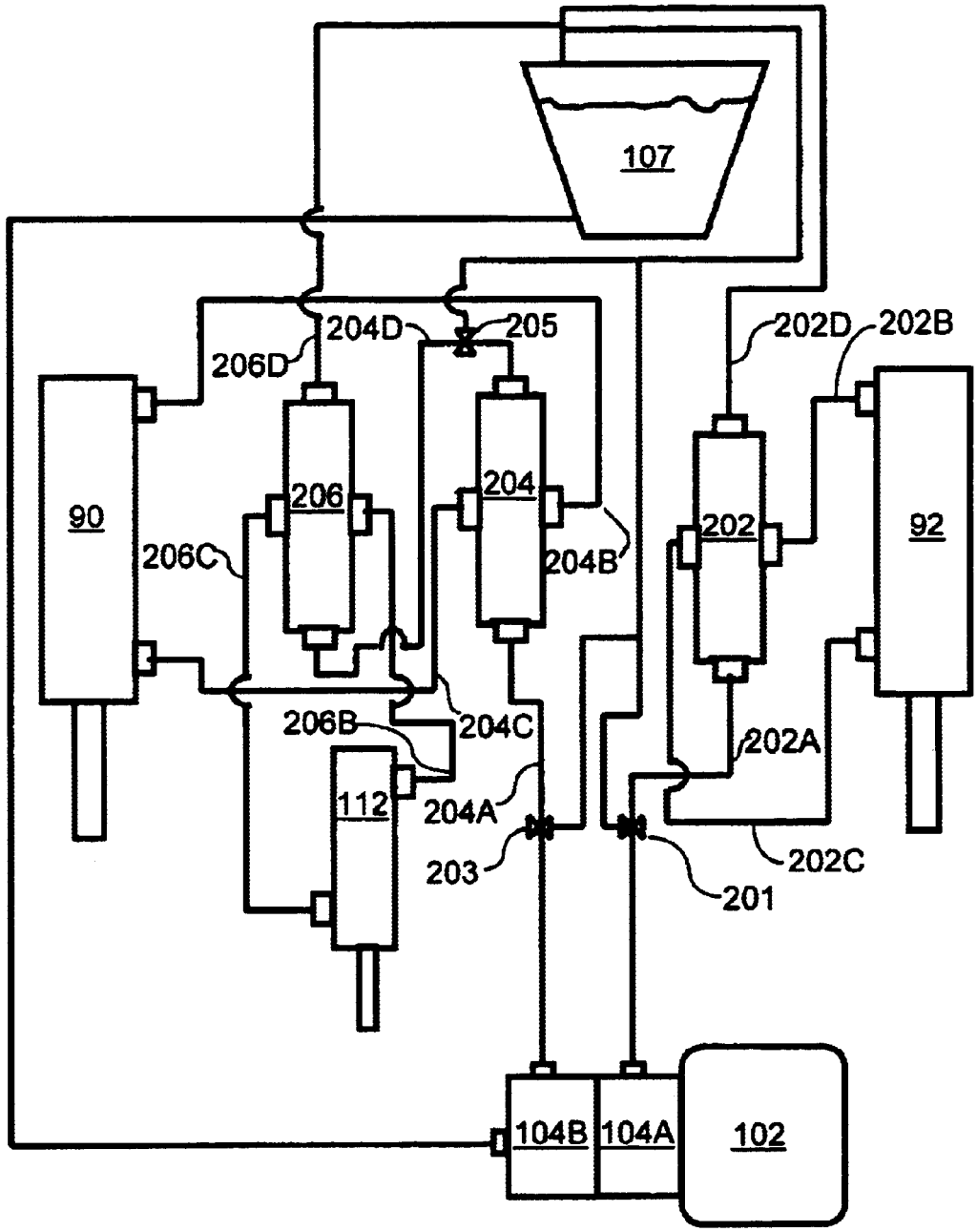
FIG. 4 is a schematic of the hydraulic system for the metal working machine of the present invention.
Figure 5:
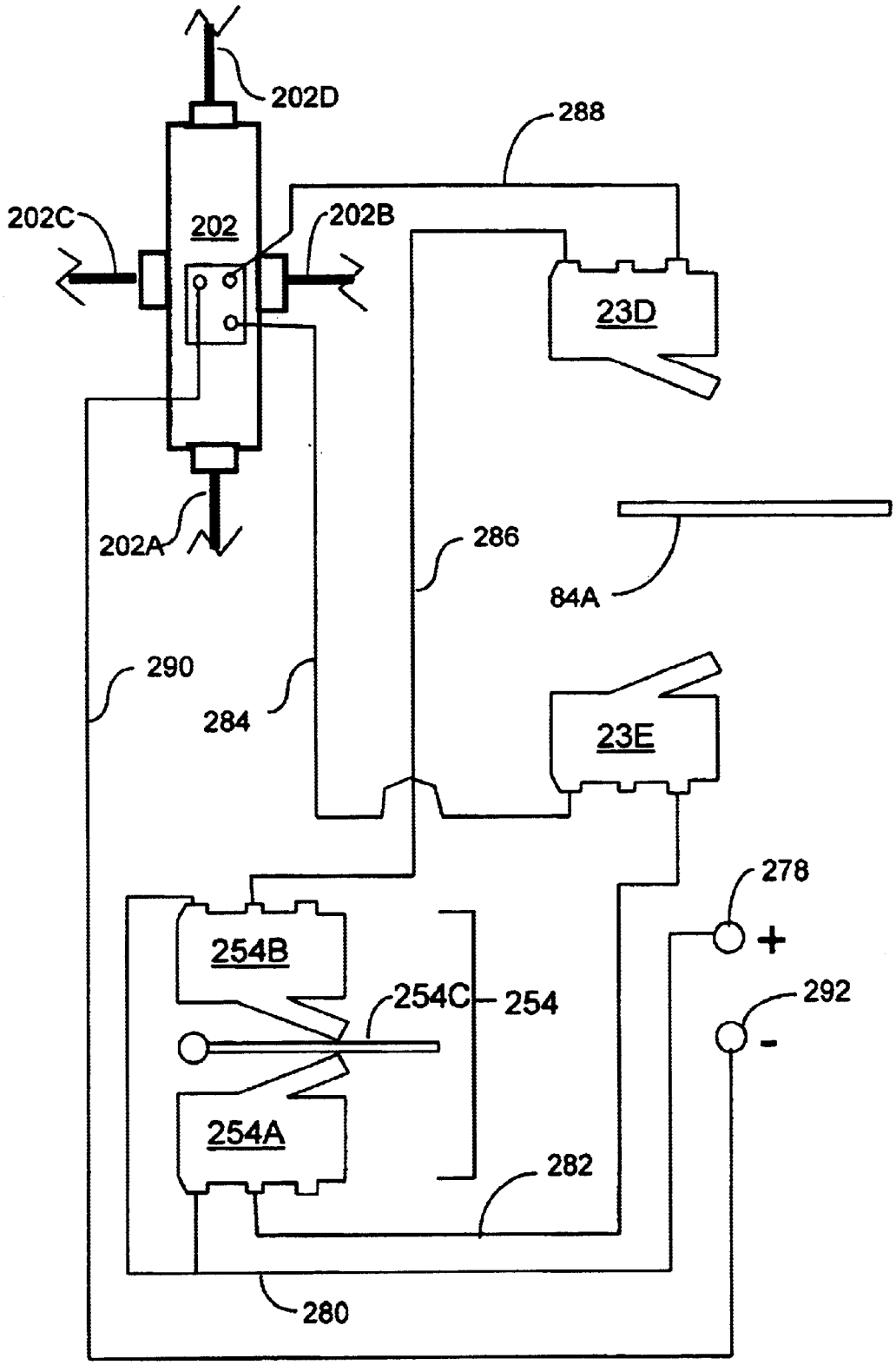
FIG. 5 is a schematic showing one of the circuits for controlling one of the control valves of the hydraulic system shown in FIG. 4.

FIG. 1 shows many of the tubes and wires leading to and from the various hydraulic cylinders and valves as broken. This is done for clarity. FIG. 4 isolates the hydraulic system from machine 10 by providing a schematic showing the arrangement of the hydraulic system and the various lines that carry hydraulic fluid in the hydraulic system. Valves 202, 204 and 206 are solenoid controlled valves. Each of these valves each can be operated in one of three modes, a neutral mode, a down mode and an up mode. Two circuits connect to each of the solenoids controlling the valves. When both circuits are open, the solenoid is inactive and the valve remains in the neutral mode. If one of the two circuits is closed, the solenoid switches the valve to the up or down. The electrical lines leading to the solenoids controlling valves 202, 204, and 206 are not shown in FIG. 4 for clarity. FIG. 5 discussed below provides a diagram of the two circuits controlling valve 202.

Valve 202 controls the action of hydraulic cylinder 92. Valve 202 receives hydraulic fluid from pump 104A which has been supplied from hydraulic fluid reservoir 107. When in the neutral mode, solenoid controlled valve 202 conveys hydraulic fluid from line 202A to line 202D which leads back to the reservoir 107. When in a down mode, solenoid controlled valve 202 conveys hydraulic fluid from line 202A to line 202B which causes hydraulic cylinder 92 to move in a downward direction. When in an up mode, solenoid controlled valve 202 conveys hydraulic fluid from line 202A to line 202C which causes hydraulic cylinder 92 to move in a upward direction. Relief valve 201 allows hydraulic fluid to flow around valve 202 to reservoir 107 when pressure in line 202A exceeds a predetermined value. A high pressure condition in line 202 a would occur if hydraulic cylinder 92 was either fully extended or retracted or if it is working against a load that is above a maximum acceptable load.

Valve 204 controls hydraulic cylinder 90. Valve 204 receives hydraulic fluid through line 204A from pump 104B. When neutral, valve 204 conveys hydraulic fluid through line 204D which leads to control valve 206. When in the down mode, valve 204 conveys hydraulic fluid to line 204B which causes hydraulic cylinder 90 to move in a downward direction. When in an up mode, valve 204 conveys hydraulic fluid to line 204C which causes hydraulic cylinder 92 to move in a upward direction. Relief valve 203 allows hydraulic fluid to flow around valve 204 to reservoir 107 in a high pressure condition.

Valve 206 receives hydraulic fluid when valve 204 is in the neutral mode. Valve 206 controls the action of hydraulic cylinder 112 and is in a neutral mode at all times except when clamp member 110 is being extended. Relief valve 205 is set at a fairly low pressure in comparison to the other relief valves because the maximum clamping force needed for clamping member 110 is not large. When valve 206 is in the down mode, fluid is directed through line 206B to cause hydraulic cylinder 112 to extend. When valve 206 is in the up mode, fluid is directed through line 206C to cause hydraulic cylinder 112 to retract.

Valves 202, 204 and 206 are normally in a neutral position. The solenoids that control valves 202, 204 and 206 which are not shown in FIG. 4 are each activated by two circuits. When a first circuit closes, the solenoid moves the valve to a down position and causes its associated hydraulic cylinder to extend. When a second circuit doses, the solenoid moves the valve to an up position and causes the associated hydraulic cylinder to retract. These circuits are therefor all controllable by switches that can be selectively closed to activate the various solenoids. The configuration shown in FIG. 4, would require six circuits with three pairs of up and down switches. The solenoids controlling valves 202 and 204 could also be controlled by combined switches so that hydraulic cylinders 90 and 92 could be operated in unison as will be described in greater detail below. Hydraulic cylinders 90 and 92 could also be operated independently as described above by controlling the solenoids for valves 202 and 204 with separate switches.

FIG. 1 illustrates a first foot switch 252, a second foot switch 254 and a third combined foot switch 256. First foot switch 252 controls the motion of hydraulic cylinder 90. Second foot switch 2 5 4 controls the motion of hydraulic cylinder 92. Combined foot switch 256 has two switches in a side by side relationship and can be used to separately control the motions of hydraulic cylinders 90 and 92 or to operate hydraulic cylinders 90 and 92 in unison. These switches could be arranged to permit a single person to control combined operations of metal working machine 10 but to not permit combined operations while a one sided operation was in progress. So, for example, any activation of combined foot switch 256 could cause foot switches 252 and 254 to be locked out. Accordingly, two operators using foot switches 252 and 254 on opposite ends of machine 10 could perform separate operations, but neither one of them could initiate an operation by activating combined foot switch 256 to significantly effect the position of a tool at the opposite end. Conversely, while one operator is operating the entire machine by using combined foot switch 256, it would be impossible for another operator to operate the machine on either end by using either foot switch 252 or 254.

Two pairs of limit switches including limit switches 22D and 22E mounted to vertical member 22 and limit switches 23D and 23E mounted to vertical member 23 shown in FIG. 1 can also be added to the control system. The operation of both pairs of these limit switches can be understood by considering the operation of limit switches 22D and 22E on the left side of machine 10. Limit switches 22D and 22E can be adjustably moved between predetermined extreme positions to automatically stop the movement of vertical member 82 at a selected location. As can be seen in FIG. 1, limit switches 22D and 22E are mounted on vertical member 22 to slide between upper and lower limits. Limit switches 22D and 22E are activated by contact with a limit finger 82A fixed to vertical member 82 of moving frame 70. Vertical member 82 moves up when hydraulic cylinder 90 retracts. When limit finger 82A contacts limit switch 22D, the closed circuit causing valve 202 of FIG. 4 to operate in an up mode is opened so that valve 202 stops operating in an up mode and switches to a neutral mode. This causes hydraulic cylinder 90 and vertical member 82 to stop moving up. In the same way, when limit finger 82A contacts limit switch 22E, the closed circuit causing valve 202 of FIG. 4 to operate in an down mode is opened so that valve 202 stops operating in the down mode and switches to a neutral mode. This causes hydraulic cylinder 90 and vertical member 82 to stop moving down. Limit switches 23D and 23E and limit finger 84A operate on the right side of machine 10 in the same manner except that they effect the operations of valve 204 and hydraulic cylinder 92. The upper and lower limits of all four limit switches should be set so that hydraulic cylinders 90 and 92 stop motion at least just prior to their fully extended or fully contracted positions. A variety of operations can be selected by setting the positions of the limit switches on both sides of machine 10. A contoured bending of a sheet metal workpiece between female break form die 26A and male break form die 72A can be arranged by setting the positions of the limit switches on both sides of the machine. The motion of machine 10 can also be constrained between a narrow set of limits for increasing the efficiency of repetitive operations by limiting the length of machine travel during a given operation.

FIG. 5 illustrates the arrangement of the two circuits that interconnect with the solenoid of control valve 202. The state of these circuits determines the mode of control valve 202 and by extension the movements of hydraulic cylinder 92. The circuit in FIG. 5 is a DC circuit that has a positive potential 278 and a negative potential 292. Positive potential 278 is connected via a line 280 with the terminals of a pair of switches 254A and 254B which are part of foot pedal switch 254. Switches 254A and 254B are normally open and only close when acted on by a toggle member 254C. Accordingly, switch 254 has an up, down and a neutral mode. Switch 254 could be arranged to be biased in any one of these three modes. If switch 254A is closed, current is conveyed through a line 282, through normally closed limit switch 23E, through line 284 to the solenoid of control valve 202. Control valve 202 responds by changing from a normally neutral mode to a down mode where hydraulic fluid is directed into hydraulic line 202B. Similarly, if switch 254B is closed, current is switched through line 286, normally closed limit switch 23D and on through line 288 to the solenoid of control valve 202. Control valve 202 then responds by changing from a normally neutral mode to an up mode where hydraulic fluid is directed into hydraulic line 202C. If normally closed limit switch 23E is activated by limit finger 84A, then the circuit activating the down mode of control valve 202 is opened and control valve 202 reverts to a neutral mode where hydraulic fluid is directed into line 202D leading hydraulic reservoir 107 shown in FIG. 4. In the same way, if normally closed limit switch 23D is activated by limit finger 84A, then the circuit activating the up mode of control valve 202 is opened and control valve 202 again reverts to a neutral mode.

The circuits controlling the operation of control valve 204 shown in FIG. 4 would have the same configuration as described above. The circuits controlling the function of control valve 206 which is coupled to hydraulic cylinder 112 would be similar to the above described circuits except that the circuits connected to the solenoid of control valve 206 would not have limit switches such as limit switches 23D and 23E shown in FIG. 5. The circuit controlling valve 206 would need only a simple switch such as switch 260 shown mounted to vertical member 23 in FIG. 1. Switch 260 need only have an up, a neutral and a down mode.

The arrangement of the above described limit switches and the relief valves in the above described hydraulic circuit provide redundant means for preventing hydraulic cylinders 90, 92 and 112 from being over loaded. As noted above, no limit switches are coupled to the operation of hydraulic cylinder 112, however, relief valve 205 of FIG. 4, is set at a relatively low pressure because hydraulic cylinder 112 does not need to apply a large force to clamp a workpiece in place. Relief valves 201 and 203 which protect hydraulic cylinders 92 and 90 respectively, on the other hand, are set at high pressures. The limit switches described above are also positioned primarily so that the male and female break form dies 72A and 26A can not push against each other or "bottom out" with a force exceeding the rated capacity of the machine. Even so, if a workpiece is placed between any of the tool arrangements of machine 10 that is too heavy to be worked by machine 10, one or both of relief valves 201 and 203 will divert the flow of hydraulic fluid to prevent damage to machine 10.

Thus, the invention meets the objects noted above by providing a metal working machine that can perform multiple operations on large workpieces while occupying a relatively limited amount of floor space. The metal working machine of the present invention, as explained above, can be controlled to perform operations on large workpieces or to perform independent operations simultaneously on workpieces at either end of the machine. The invention machine can shear relatively wide sheets of material, bend sheets of material, punch holes in sheet or plate material and shear heavy extruded angles and even be used to perform some of these operations independently and simultaneously by more than one operator. The invention machine can even bend sheet material with a gradually increasing angle of bend to form a contoured bend as each end of the machine is set to translate within pre-selected limits. Accordingly, the metal working machine of the present invention provides a highly effective, compact and versatile work station which can be used to greatly increase the efficiency and productivity of those who perform metal working operations.

The invention has been described above in considerable detail in order to comply with the patent laws by providing a full public disclosure of at least one of its embodiments. However, such a detailed description is not intended in any way to limit the broad features or principles of the invention, or the scope of patent monopoly to be granted. The skilled reader, in view of this specification may envision numerous modifications and variations of the above disclosed preferred embodiment. Accordingly, the reader should understand that these modifications and variations, and the equivalents thereof, are within the spirit and scope of this invention as defined in the following claims.

I claim:

1. A metal working machine comprising:

(a) a substantially rectangular, stationary frame having a right side and a left side, the stationary frame having right and left columns rigidly connected by top and bottom beams, (b) a moving frame having a right side and a left side, the moving frame including right and left vertical members that are pivotably joined with top and bottom horizontal members, the moving frame mounted to the stationary frame so that the top and bottom horizontal members of the moving frame may slide along substantially vertical paths relative to the left and right columns of the stationary frame as the right and left vertical members of the moving frame move along substantially vertical paths that are next to and substantially parallel with the right and left columns of the stationary frame, (c) right and left hydraulic cylinders served by independently controllable hydraulic circuits, each hydraulic cylinder respectively connecting the right side of the moving frame to the right side of the stationary frame and the left side of the moving frame to the left side of the stationary frame, each hydraulic cylinder operable between an unextended position and an extended position the right and left hydraulic cylinders controllable by a control to operate in unison so that both sides of the moving frame move in unison, the right and left hydraulic cylinders also controllable to operate independently so that one side of the moving frame may be moved while the other side remains substantially stationary, (d) at least one pair of tool dies including a first tool mounted to the stationary frame and a corresponding second tool mounted to the moving frame, the first and second tools mounted to corresponding locations on the stationary frame and the moving frame so that when a workpiece is placed between the first tool and the second tool, an operation may be performed on the work piece as the second tool moves relative to the first tool as at least one of the right or left hydraulic cylinders is operated between the unextended position and the extended position.

2. The metal working machine of claim 1, wherein, the tool dies include pairs of tool dies selected from the group consisting essentially of (1) a first pair of tool dies in an opposite corresponding relationship including a tool die fixed to the bottom beam of the stationary frame between the columns thereof and a second tool die fixed to the bottom horizontal member of the moving frame between the vertical members thereof, (2) a second pair of tool dies in an opposite corresponding relationship including a tool die fixed to the top beam of the stationary frame between the columns thereof and a second tool die fixed to the top horizontal member of the moving frame between the vertical members thereof, (3) a third pair of tool dies in an opposite corresponding relationship including a tool die fixed to the stationary frame toward the right end thereof and a tool die fixed to moving frame toward the right end thereof, and (4) a fourth pair of tool dies in an opposite corresponding relationship including a tool die fixed to the stationary frame toward the left end thereof and a tool die fixed to moving frame toward the left end thereof.

3. The metal working machine of claim 1, further comprising:

at least one limit switch coupled with the hydraulic cylinders, the limit switch including a finger and a switch mounted to corresponding portions of the moving frame and the stationary frame so that when the finger contacts the switch to stop the motion of the moving frame relative to the stationary frame when a predetermined degree of motion of the moving frame relative to the stationary frame has occurred.

4. The metal working machine of claim 1, further comprising:

at least one limit switch coupled with the hydraulic cylinders, the limit switch including a member and a switch that are mounted to corresponding portions of the moving frame and the stationary frame so that the relative distance between the finger and the switch can be changed and so that when the finger contacts the switch, the motion of the moving frame relative to the stationary frame stops when the moving frame has moved relative to the stationary frame by a pre-selected amount.

5. The metal working machine of claim 1, further comprising:

at least two limit switches coupled with the hydraulic cylinders, the limit switches mounted on opposite sides of the machine, each limit switch including a finger and a switch mounted to corresponding portions of the moving frame and the stationary frame so that when the finger contacts the switch, the motion of the hydraulic cylinder mounted on the same side of the metal working machine as the limit switch stops when the moving frame has moved relative to the stationary frame by a pre-selected amount.

6. The metal working machine of claim 1, further comprising:

at least two limit switches coupled with the hydraulic cylinders, the limit switches mounted on opposite sides of the machine, each limit switch including a finger and a switch mounted to corresponding portions of the moving frame and the stationary frame so that the relative distance between the finger and the switch can be changed and so that when the finger contacts the switch, the motion of the hydraulic cylinder mounted on the same side of the metal working machine as the limit switch stops when the moving frame has moved relative to the stationary frame by a pre-selected amount.

7. A metal working machine comprising;

(a) a substantially rectangular, stationary frame having a right side and a left side, the stationary frame having right and left columns rigidly connected by at least a first tool support beam and a second tool support beam positioned above the first tool support beam, (b) a moving frame having a right side and a left side, the moving frame including right and left vertical members that are pivotably joined with top and bottom horizontal members, the moving frame mounted to the stationary frame so that the top and bottom horizontal members of the moving frame may slide along substantially vertical paths relative to the left and right columns of the stationary frame as the right and left vertical members of the moving frame move along substantially vertical paths that are next to and substantially parallel with the right and left columns of the stationary frame, (c) pairs of corresponding tool dies fixed to the stationary frame and the moving frame selected from the group consisting of: (1) a first pair of tool dies in an opposite corresponding relationship including a tool die fixed to the first tool support beam of the stationary frame between the right and left columns thereof and a tool die fixed to the bottom horizontal member of the moving frame between the vertical members thereof, (2) a second pair of tool dies in an opposite corresponding relationship including a tool die fixed to the second tool support beam of the stationary frame between the right and left columns thereof and a tool die fixed to the top horizontal member of the moving frame between the vertical members thereof, (3) a third pair of tool dies in an opposite corresponding relationship including a tool die fixed to the stationary frame toward the right end thereof and a tool die fixed to moving frame toward the right end thereof, and (4) a fourth pair of tool dies in an opposite corresponding relationship including a tool die fixed to the stationary frame toward the left end thereof, and a tool die fixed to moving frame toward the left end thereof, (d) a right hydraulic cylinder and a left hydraulic cylinder, the right hydraulic cylinder connecting the moving frame to the stationary frame by connecting between a portion of the moving frame toward the right end thereof and a portion of the stationary frame toward the right end thereof, the left hydraulic cylinder connecting the moving frame to the stationary frame by connecting between a portion of the moving frame toward the left end thereof and a portion of the stationary frame toward the left end thereof, the right and left hydraulic cylinders operable between unextended positions and extended positions, each hydraulic cylinder coupled to a hydraulic circuit, each hydraulic circuit operable in a down mode wherein the hydraulic cylinder coupled thereto moves so that the portion of the moving frame attached thereto moves down, an up mode wherein the hydraulic cylinder coupled thereto moves so that the portion of the moving frame attached thereto moves up and a neutral mode wherein the hydraulic cylinder coupled thereto does not move, each hydraulic circuit controllable by a control to operate in unison so that both ends of the moving frame move in unison or controllable by separate controls so that each end of the moving frame may be moved independently, so that working operations may be performed that are selected from a group of operations consisting essentially of (1) an operation performed on a workpiece placed between a pair of tool dies selected from the group consisting of the first and second pairs of tool dies as the hydraulic cylinders move substantially in unison (2) an operation performed on a workpiece placed between a pair of tool dies selected from the group consisting of the third and fourth pairs of tool dies as the hydraulic cylinders move substantially in unison, and (3) an operation performed on a workpiece placed between a pair tool dies selected from the group consisting of the third and fourth pairs of tool dies as only the hydraulic cylinder mounted toward the same end of the metal working machine as the selected pair of tool dies is moved.

8. The metal working machine of claim 7, further comprising:

at least two limit switches coupled with the control that controls the hydraulic cylinders, the limit switches mounted on opposite sides of the machine, each limit switch including a finger and a switch mounted to corresponding portions of the moving frame and the stationary frame so that when the finger contacts the switch, the motion of the hydraulic cylinder mounted on the same side of the metal working machine as the limit switch stops moving when a predetermined degree of motion of the moving frame relative to the stationary frame has occurred.

9. The metal working machine of claim 7, further comprising:

at least two limit switches coupled with the with the control that controls the hydraulic cylinders, the limit switches mounted on opposite sides of the machine, each limit switch including a finger and a switch mounted to corresponding portions of the moving frame and the stationary frame so that the relative distance between the finger and the switch can be adjusted and so that when the finger contacts the switch, the motion of the hydraulic cylinder mounted on the same side of the metal working machine as the limit switch stops moving when a predetermined degree of motion of the moving frame relative to the stationary frame has occurred.

10. The metal working machine of claim 7, wherein:

the first and second pairs of tool dies are configured to provide a break form die and sheet metal shear.

11. The metal working machine of claim 7, wherein:

the first pair of tool dies is a female break form die fixed to the first tool support beam of the stationary frame and a corresponding male break form die fixed to the bottom horizontal member of the moving frame, and the second pair of tool dies is a pair of corresponding sheet metal shear blades fixed to the second tool support beam of the stationary frame and the top horizontal member of the moving frame.

12. The metal working machine of claim 7, wherein:

the first and second pairs of tool dies are configured to provide a break form die and sheet metal shear, and wherein, the second and third pairs of tool dies are configured to provide a shear and a hole punch tool.

13. The metal working machine of claim 7, wherein:

the first pair of tool dies is a female break form die fixed to the first tool support beam of the stationary frame and a corresponding male break form die fixed to the bottom horizontal member of the moving frame, and the second pair of tool dies is a pair of corresponding sheet metal shear blades fixed to the second tool support beam of the stationary frame and the top horizontal member of the moving frame, and wherein, the second and third pairs of tool dies are configured to provide a shear and a hole punch tool.

* * * * *